US008390879B2

(12) United States Patent
Masuda et al.

(10) Patent No.: US 8,390,879 B2
(45) Date of Patent: Mar. 5, 2013

(54) IMAGE FORMING APPARATUS

(75) Inventors: Junichi Masuda, Toyokawa (JP); Seiji Aoki, Chofu (JP); Yoshiki Nakazawa, Toyokawa (JP); Takahiro Doi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1523 days.

(21) Appl. No.: 11/934,453

(22) Filed: Nov. 2, 2007

(65) Prior Publication Data

US 2008/0117445 A1 May 22, 2008

(30) Foreign Application Priority Data

Nov. 16, 2006 (JP) ..... 2006-310169

(51) Int. Cl.
*B41J 1/00* (2006.01)

(52) U.S. Cl. ..... 358/1.9; 358/1.1; 358/1.15

(58) Field of Classification Search ..... 358/1.9, 358/1.15; 399/49, 27
See application file for complete search history.

(56) References Cited

U.S. PATENT DOCUMENTS

| | | | | |
|---|---|---|---|---|
| 7,145,694 | B2 * | 12/2006 | Suzuki et al. | 358/2.1 |
| 2005/0025509 | A1 * | 2/2005 | Ooki et al. | 399/49 |
| 2008/0031644 | A1 * | 2/2008 | Kin et al. | 399/27 |

FOREIGN PATENT DOCUMENTS

| | | |
|---|---|---|
| JP | 7-20669 | 1/1995 |
| JP | 9-99588 | 4/1997 |
| JP | 2000-206744 | 7/2000 |
| JP | 2001-147563 | 5/2001 |
| JP | 2002-174929 | 6/2002 |
| JP | 2002-244495 | 8/2002 |
| JP | 2003-91151 | 3/2003 |
| JP | 2003-295534 | 10/2003 |
| JP | 2003-334975 | 11/2003 |
| JP | 2005-043617 | 2/2005 |
| JP | 2006-23392 | 1/2006 |
| JP | 2006-184304 | 7/2006 |

OTHER PUBLICATIONS

Japanese Office Action mailed on Nov. 4, 2008 directed towards foreign application No. 2006-310169; 6 pages.

* cited by examiner

*Primary Examiner* — King Poon
*Assistant Examiner* — Iriana Cruz
(74) *Attorney, Agent, or Firm* — Morrison & Foerster LLP

(57) ABSTRACT

An image forming apparatus includes a effective resolution determinator for forming a plurality of patch patterns different in resolution by the output engine, checking by sensor whether or not the patch patterns formed by the output engine are developed with developer, and determining that a resolution of the patch pattern with highest resolution recognizable by the sensor is an effective resolution which can be outputted by the output engine; and a dot counter for counting number of dots constituting an image of not less than effective resolution in the printing data, by which an error in estimated toner consumption, caused by dots too small to be developed, is reduced.

11 Claims, 10 Drawing Sheets

IMAGE FORMING APPARATUS

RELATED APPLICATION

The present invention is based on Patent Application No. 2006-310169 filed in Japan.

BACKGROUND OF THE INVENTION

The present invention relates to an electrophotographic-type image forming apparatus.

The electrophotographic-type image forming apparatus is composed of an output engine for charging a photoconductor, selectively exposing the charged photoconductor to form an electrostatic latent image while scanning the charged photoconductor, and feeding a developer to the electrostatic latent image so as to develop it, and a controller for converting image data received from an external or other component to printing data consisting of data sets continuing in a main scanning direction of the output engine and inputting the image data into the output engine for image output.

The output engine applies a laser beam to the photoconductor to lower its potential, so that toner is adsorbed and hence a toner image is developed. Accordingly, nominal resolution of the output engine is determined by the diameter of a laser beam which exposes the photoconductor. However, while the resolution in a sub scanning direction depends on the diameter of the laser beam which exposes the photoconductor, the resolution in the main scanning direction depends on a travel distance of a laser beam, corresponding to a time during which an applied amount of the laser beam, sufficient enough to lower the potential of the photoconductor to the level of the toner adsorption, can be secured when the focus of the laser beam moves at a specified speed on the photoconductor.

Thus, the controller of a conventional image forming apparatus converts the image data to printing data having the nominal resolution of the output engine with respect to the sub scanning direction and having upper limit resolution with respect to the main scanning direction.

More specifically, the output engine attempts to apply a laser beam in compliance with high-definition data in the main scanning direction to be inputted and to develop dots with definition higher than the nominal resolution. However, independent dots of high definition cannot secure an enough application amount even when the laser beam is applied, which causes insufficient attachment of the toner, resulting in substantial failure of development.

In the field of image forming apparatuses, a technology is publicly known, in which the number of dots to be outputted based on the printing data is counted by a dot counter to estimate the consumption of toner. When a conventional image forming apparatus outputs, in the main scanning direction, an image containing a number of small independent dots which cannot be developed by their output engines, the toner consumption estimated based on an integrated value from the dot counter sometimes becomes larger than actual toner consumption, and thereby issues a toner empty alert regardless of the presence of enough remaining toner.

Disclosed in JP 2001-147563 A and US 2005/0025509 A1 is a technology in which a patch image is formed so as to check the concentration of developed toner by a sensor so that laser beam outputs are adjusted and corrected in order to correct changes in image concentration attributed to changes in laser output caused by contamination.

Disclosed in JP 2005-43617 A is a technology in which a patch pattern is outputted so as to check the concentration of developed toner by a sensor and to correct printing data in order to achieve appropriate tone reproduction.

Although these technologies increase the accuracy in estimation of toner consumption in halftone, they cannot eliminate estimation error in toner consumption caused by inability to develop the aforementioned fine dots.

SUMMARY OF THE INVENTION

An object of the present invention is to provide, in view of the aforementioned problems, an image forming apparatus free from error in estimated toner consumption, the error caused by fine dots which cannot be developed.

In order to accomplish the object, there is provided, in a first aspect of the present invention, an image forming apparatus, comprising an output engine having a photoconductor, a charger for charging the photoconductor, an exposure device for forming an electrostatic latent image by selectively exposing the charged photoconductor while scanning the charged photoconductor and a developing device for feeding a developer to the electrostatic latent image for development, and a controller for converting image data received from an external or other component to printing data consisting of continuous data in a main scanning direction of the exposure device and for inputting the converted data into the output engine so as to output an image, wherein the image forming apparatus has an effective resolution determinator for forming a plurality of patch patterns different in resolution by the output engine, checking by sensor whether or not the patch patterns formed by the output engine are developed with developer and determining that a resolution of the patch pattern with highest resolution recognizable by the sensor is an effective resolution which can be outputted by the output engine, and a dot counter for counting number of continuous dots constituting an image equal to or longer than a length of one dot of the effective resolution in the printing data.

According to the structure, the effective resolution determinator determines the lower limit of the number of continuous dots which can be developed and visualized by the output engine, i.e., the upper limit of resolution, while the dot counter excludes those dots smaller than the length of one dot of effective resolution and counts only the dots estimated to be outputted with certainty, which ensures a strong correlation between the counted dot number and actual consumption of developer.

In the image forming apparatus of the present invention, the controller checks nominal resolution guaranteed by the output engine and instructs the output engine to form only the patch patterns with resolution higher than the nominal resolution and not to form the patch patterns with low resolution which is clearly developable, so that an economical operation can be achieved.

In the image forming apparatus of the present invention, the output engine is unable to output data with high resolution in the sub scanning direction, and therefore the controller does not create data which cannot be developed in the sub scanning direction from the start. Consequently, the dot counter has only to count the number of dots continuing for a length equal to or longer than a length corresponding to one dot of the effective resolution.

In the image forming apparatus of the present invention, the effective resolution determinator further defines the resolution of the patch pattern with lowest resolution, among the patch patterns unreadable by the sensor, as ineffective resolution, and the dot counter may also count half the number of dots continuing for a length equal to or longer than a length of one dot of the ineffective resolution and shorter than a length of one dot of the effective resolution.

According to the structure, it is unknown whether or not the dots, whose resolution is not recognized in formation of patch patterns with resolution ranging from ineffective resolution to effective resolution, are actually outputted. An actual developer consumption can often be expressed accurately by counting one dot as 0.5 dot rather than by neglecting all the dots with intermediate resolution.

In the image forming apparatus of the present invention, the effective resolution determinator may determine the effective resolution at least for every certain number of printing pages, at power-on, or during image stabilization operation.

According to the structure, checking the effective resolution according to needs allows accurate understanding of the consumption of the developer, since the size of the dots, which can actually be outputted, varies depending on temperature, humidity, electric charges of the developer and other conditions.

In the image forming apparatus of the present invention, a remaining amount of developer in a developer bottle for feeding the developer to the developing device may be estimated based on dot number counted by the dot counter, or a remaining amount of the developer in the developing device may be estimated.

In the image forming apparatus of the present invention, when the dot number counted by the dot counter is smaller than a value obtained by multiplying a predetermined amount by the printing page number, a certain amount of old developer, which may contain impurities from the developing device or have electric charge failure, is discharged on a mandatory basis, so that new developer can be fed to the developing device, ensuring the developer to be in appropriate condition.

There is provided, in a second aspect of the present invention, an image forming apparatus for forming images on a recording object based on image data, including a dot counter for counting dot number of the inputted image data; a condition determinator for determining a determination condition for determining whether or not the dots of the image data are formed on the recording object and a count controller for preventing image data of dots, which are determined not to be formed on the recording object based on the determination condition, among the image data, from being inputted into the dot counter.

According to the structure, the dot counter counts only the dot numbers determined not to be formed on the recording object by the condition determinator, so that consumption of developer can be appropriately estimated from the count value from the dot counter.

In the image forming apparatus in the second aspect of the present invention, image data of the dots, determined to be formed on the recording object based on the determination condition, may be inputted into the dot counter.

The image forming apparatus in the second aspect of the present invention further includes a sensor for detecting density of images formed on the recording object, wherein the condition determinator may form patch pattern images, different in resolution, on the recording object and may determine the determination condition based on density of the patch pattern images detected by the sensor.

In the image forming apparatus in the second aspect of the present invention, the condition determinator may determine that the image data, having a length equal to or longer than one dot of the patch pattern images, detected to have density higher than specified density by the sensor, is formed on the recording object.

According to the present invention, the effective resolution of the output engine is determined so that only the number of dots considered to be actually outputted is counted, thus allowing accurate estimation of consumption of the developer.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

Description is now given of the embodiments of the present invention with reference to the drawings.

Figure 1:
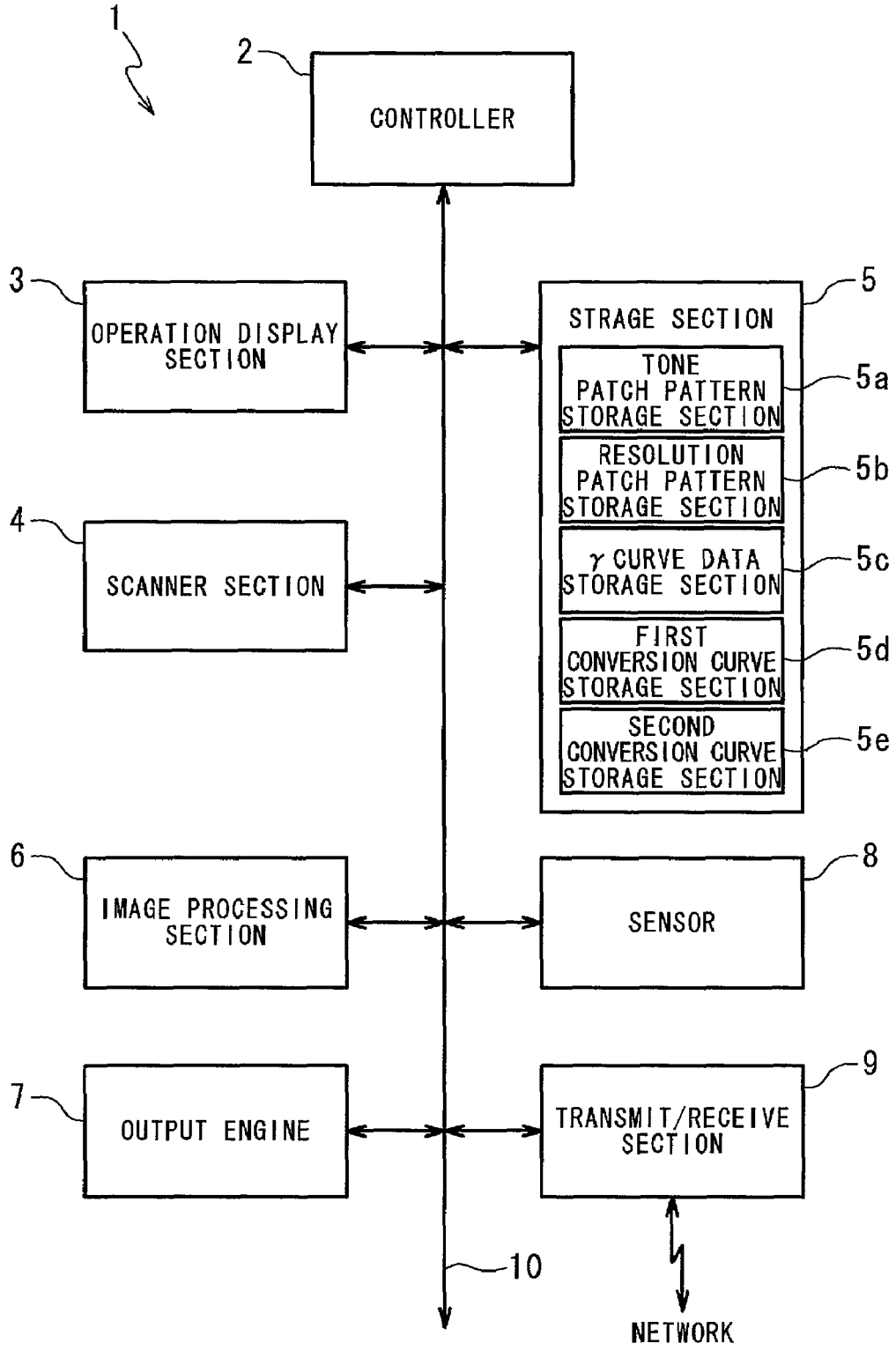
FIG. 1 is a block diagram showing an image forming apparatus in a first embodiment of the present invention.

FIG. 1 is a block diagram showing an image forming apparatus 1 in a first embodiment of the present invention. The image forming apparatus 1 includes a controller 2, an operation display section 3, a scanner section 4, a storage section 5, an image process section 6, an output engine 7, a sensor 8 and a transmit/receive section 9, each section being connected through a bus 10.

The controller 2 is composed of, for example, a CPU (Central Processing Unit), a ROM (Read Only Memory) and a RAM (Random Access Memory). In response to operation in the operation display section 3, the CPU in the controller 2 reads out a system program and various processing programs stored in the ROM, loads them into the RAM, and performs centralized control over operation of each section in the image forming apparatus 1 according to the loaded programs. The CPU also executes various processes including a later-described effective resolution determination process (effective resolution determinator) and a toner consumption calculation process (dot counter) according to the loaded programs.

The operation display section 3 is constituted of an LCD (Liquid Crystal Display) for displaying various operation buttons, states of the apparatus, operational conditions of each function and the like, on the display screen in response to instructions of display signals inputted from the controller 2. The surface of the LCD display screen is covered with a pressure sensitive-type (pressure sensitive resistance film type) touch panel, structured from transparent electrodes arranged in grid pattern, in which an X-Y coordinate of a stressed point pressed by fingers, touch pens and the like is detected as a voltage value, and the detected voltage value, i.e., the location signal, is outputted into the controller 2 as an operation signal. The operation display section 3, which has various operation buttons such as numerical buttons and a start button, outputs operation signals into the controller 2 upon operation of these buttons.

The scanner section 4 is structured to have a scanner below a contact glass on which original documents are placed, for reading images of the original documents. The scanner, which includes a light source, a CCD imaging device and an A/D converter, reads an image of an original document as RGB signals through imaging and photoelectric conversion of reflected light of a light beam applied from the light source to the original document for scanning, and performs AD conversion of the read image before outputting it to the image processing section 6.

The storage section 5, which is structured from a flash memory and the like, has a gradation patch pattern storage section 5*a* for storing YMCK data for forming gradation patch pattern images, a resolution patch pattern storage section 5*b* for storing YMCK data for forming resolution patch pattern images, a γ curve data storage section 5*c* for storing γ curve data for correcting gradation characteristics of the output engine 7 for every color of Y, M, C and K, a first conversion curve storage section 5*d* for storing conversion curves for converting RGB data obtained from the scanner section 4 into XYZ data, and a second conversion curve storage section 5*e* for storing conversion curves for converting sensor values outputted by the sensor 8 into XYZ data.

The conversion curves for converting RGB data into XYZ data are preferably formed by using mean values of a plurality of paper types.

The image processing section 6 converts the RGB data obtained through readout by the scanner section 4, or the RGB data transmitted from the transmit/receive section 9, into XYZ data with use of the conversion curves stored in the first conversion curve storage section 5*d*, performs color conversion process for converting the XYZ data into YMCK data, and perform an image treatment, such as γ correction process for correcting the characteristics of tone reproduction of the output engine 7 with use of the γ curve data for each color stored in the γ curve data storage section 5*c* and halftone process, to each YMCK data, before outputting each data into the output engine 7. Based on instructions from the controller 2, the image processing section 6 also reads YMCK data which is stored in the gradation patch pattern storage section 5*a* for forming tone patch pattern images, and outputs the data into the output engine 7.

The controller 2 forms a gradation patch pattern image, stored in the gradation patch pattern storage section 5*a*, on an intermediate transfer belt 12 of the output engine 7 with certain timing, such as at startup of the image forming apparatus 1 or at certain printing intervals according to the loaded program, converts reflectance, obtained through readout of each patch by the sensor 8, into XYZ data with use of the conversion curves stored in a second conversion curve storage section 5*d*, and performs γ curve data correction process for changing γ curve data, which is for use in γ correction process in the image processing section 6, based on the obtained result.

The output engine 7 forms and outputs an image onto recording paper P by the electrophotographic method based on YMCK image data outputted from the image processing section 6.

Figure 2:
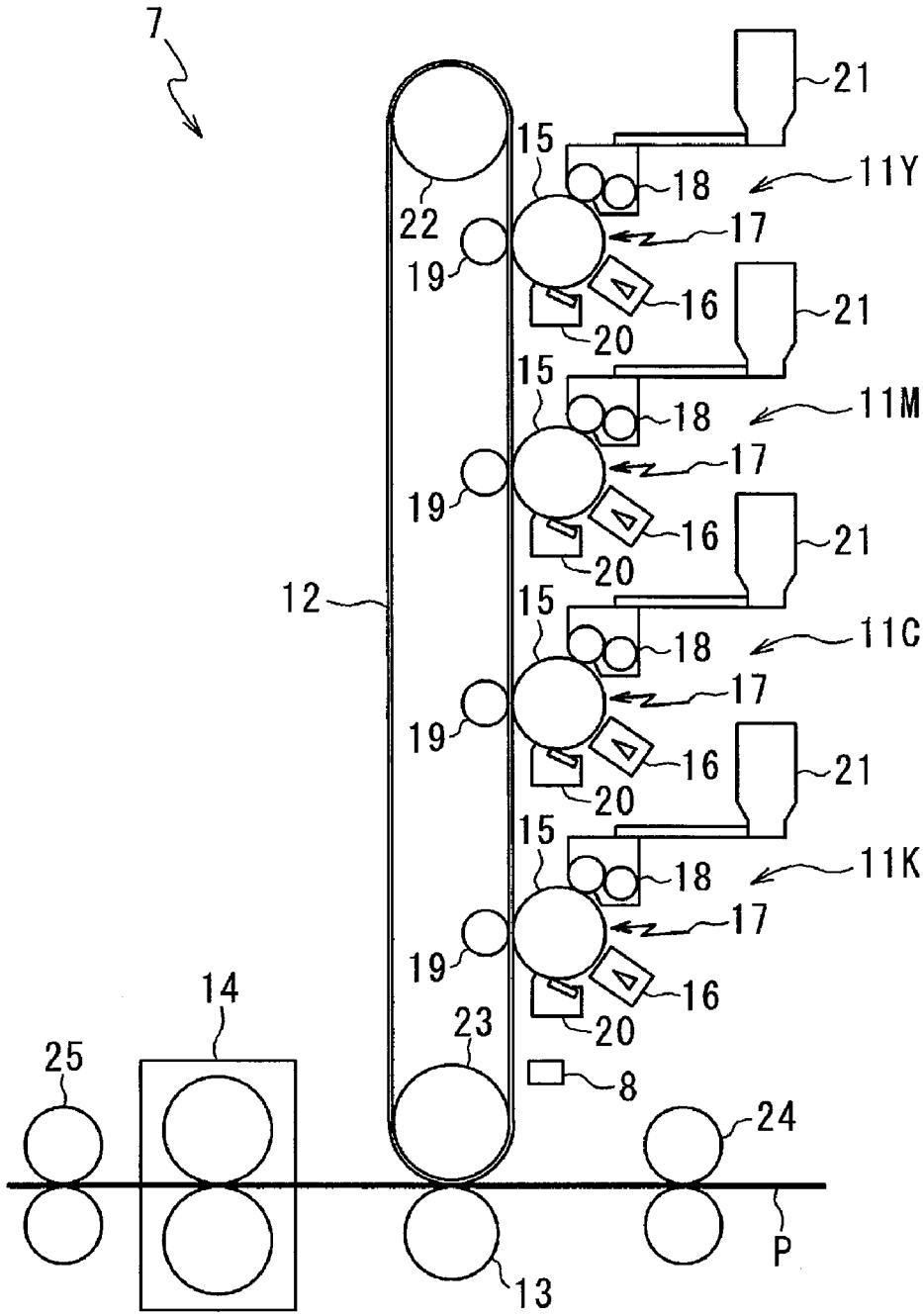
FIG. 2 is a schematic view showing an output engine shown in FIG. 1.

FIG. 2 shows main structure of the output engine 7. As shown in FIG. 2, the output engine 7 is composed of developing units 11Y, 11M, 11C, 11K forming images with toners in colors Y (Yellow), M (magenta), C (Cyan), and K (Black), an intermediate transfer belt (recording body) 12 onto which toner images formed by the developing units 11Y, 11M, 11C, 11K are primary-transferred, a secondary transfer roller 13 for secondary-transferring the toner images from the intermediate transfer belt 12 to the recording paper P, and a fixing device 14 for fixing toner images onto the recording paper P.

The developing unit 11Y is composed of a drum-like photoconductor 15 which is rotatably supported, a charger 16 for charging the photoconductor 15, an exposure device 17 for applying a laser beam to the surface of the photoconductor 15, which is charged and rotating, and thereby lowering its potential so as to form electrostatic images, a developing device 18 for developing toner images by feeding toner to the surface of the photoconductor 15 so that only a portion of the electrostatic image with low potential absorbs the toner, a primary transfer roller 19 for primary-transferring the toner images onto the intermediate transfer belt 12 by electrostatic force, a cleaner 20 for scraping the toner which failed to be used in the primary transfer and left on the photoconductor 15, and a toner bottle 21 for feeding toner to the developing device 18. The structure of other developing units 11M, 11C and 11K are similar to that of the developing unit 11Y.

The intermediate transfer belt 12 rotates in the state of being stretched over a drive roller 22 and a secondary transfer opposite roller 23, and a sensor 8 is placed immediately after the black developing unit 11K for determining the color of a transferred toner image. The output engine 7 further includes a resist roller 24 for transporting the recording paper P, and an out feed roller 25 for ejecting the recording paper P.

The exposure device 17 is structured to scan so that a focus of a laser beam on the rotating photoconductor 15 moves in axial direction (main scanning direction) while turning the laser beam on and off in order to achieve selective decrease in potential of the photoconductor 15. The exposure device 17 can form two-dimensional electrostatic images on the photoconductor 15 by scanning so that a trace line of the focus of the laser beam aligns without space in the rotational direction (sub scanning direction) of the photoconductor 15.

The controller 2 converts printing data, received from a network via the transmit/receive section 9, or printing data, read by the scanner section 4, into printing data for each color of yellow, magenta, cyan and black, the printing data consisting of digital data strings with dot values lined in order, with its resolution with respect to the main scanning direction being an upper-limit resolution that the controller 2 can process while its resolution with respect to the sub scanning direction being a resolution equivalent to nominal resolution of the output engine 7 determined by a laser diameter of the exposure device 17. The controller 2 outputs the converted data into the output engine 7.

The developing units 11Y, 11M, 11C, 11K respectively form a toner image on each photoconductor 15 based on data for each color received from the controller 2, and then lay each toner image on the intermediate transfer belt 12 for primary transfer, so that a color image can be formed on the intermediate transfer belt 12.

In the secondary transfer, recording paper P passes a pressure contact section of the secondary transfer roller 13, so that YMCK toner images on the intermediate transfer belt 12 are transferred onto the recording paper P. The recording paper P with the YMCK toner images transferred thereon passes the fixing device 14, in which the YMCK toner images are fixed onto the recording paper P by pressure and heat provided by the fixing device 14. The recording paper P carrying the image formed in this way is transported to an unshown ejection tray or the like by an out feed roller 25. In the case of double face printing, the recording paper P with an image formed on its one surface is turned over by an unshown double face transportation unit, and then is transported to the secondary transfer roller 13 by the resist roller 24 so that an image is formed again on the other surface carrying no image.

The transmit/receive section 9, which includes a modem, a LAN adapter, a router, and a TA (Terminal Adapter), controls communication with each device connected to the network through a dedicated line or communication lines such as ISDN lines.

Figure 3:
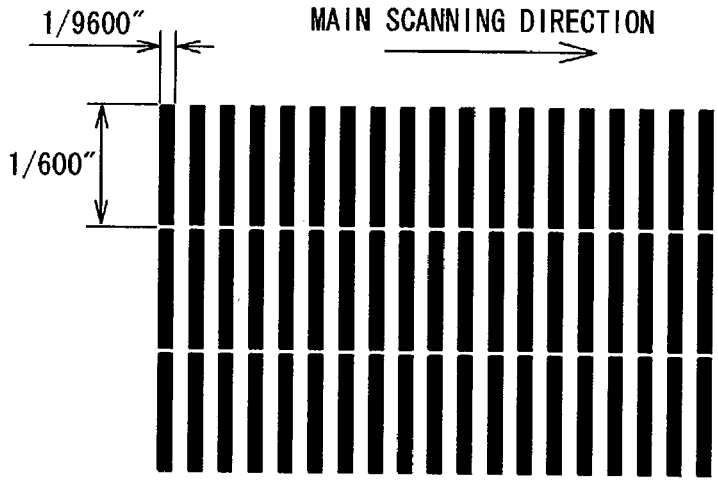
FIG. 3 is a view showing an image exemplifying a resolution patch pattern for the image forming apparatus shown in FIG. 1.

FIG. 3 shows a resolution patch pattern stored in the resolution patch pattern storage section 5*b* in the storage section 5 by way of example. The resolution patch pattern storage section 5*b* in the storage section 5 stores a plurality of patch patterns different in resolution, which are in the range of an upper-limit resolution that the controller 2 can process to the lowest resolution of the output engine 7 potentially compatible with the image forming apparatus 1. For example, in the image forming apparatus 1 having the controller 2 with an upper-limit resolution of 19200 dpi, the resolution patch pattern storage section 5*b* stores resolution patch patterns with resolutions of 19200 dpi, 9600 dpi, 4800 dpi, 2400 dpi, 1200 dpi and 600 dpi.

In the resolution patch patterns, straight lines with a density of 100%, having a width (e.g., 1/9600") corresponding to each resolution (e.g., 9600 dpi) in the main scanning direction and extending in the sub scanning direction, are repeatedly placed at intervals corresponding to the same resolution. Therefore, the resolution patch patterns, as a whole, are logically image data with a density of 50%. When the patch patterns are converted to printing data by the controller 2, square dots having a length corresponding to the resolution of the output engine 7 (e.g., 600 dpi) in the sub scanning direction are to be outputted in a repeated manner.

The resolution patch patterns of Y, M, C and K colors are respectively outputted onto the intermediate transfer belt 12 so as not to be laid on top of each other, and are read by the sensor 8 so that the later-described effective resolution determination process is performed separately for each of the Y, M, C and K colors. In a simplified method, only one of the colors may be checked and its effective resolution may apply to other colors.

It is not imperative that the resolution patch patterns should accurately be placed in the sub scanning direction, and so the resolution patch patterns may be arranged alternately so as to represent a check pattern. Moreover, it is not imperative that the width of dot data should be equal to the width of blank data, and so it is possible, for example, to interpose blank data twice as large as dot data between the dot data so as to have patterns with a logical density of 33.3%.

Figure 4:
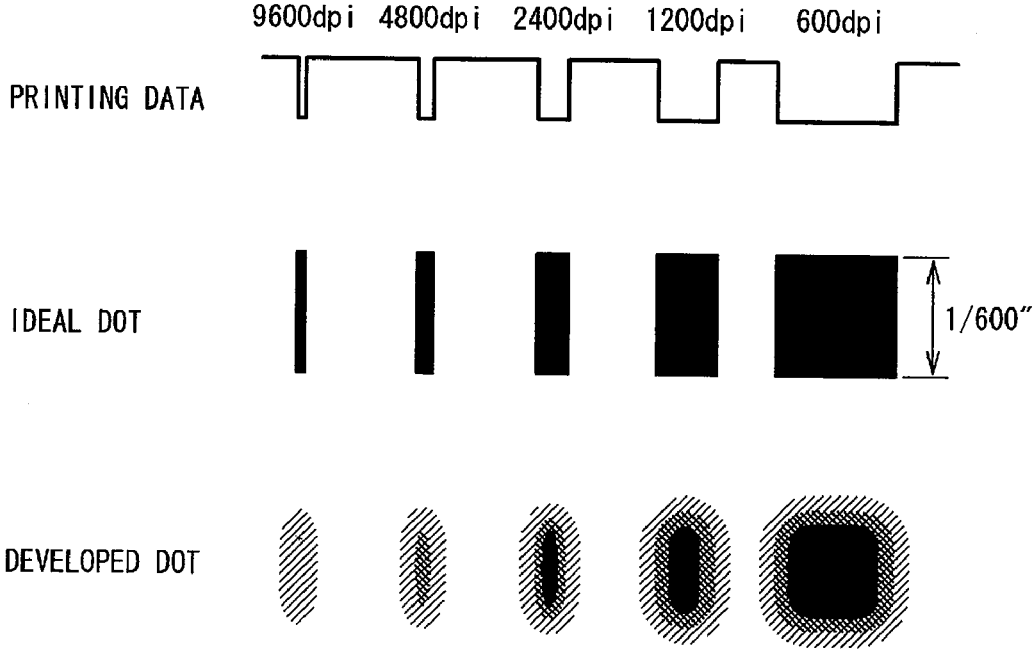
FIG. 4 is a view showing a dot shape developed according to printing data in the image forming apparatus shown in FIG. 1.

FIG. 4 shows a relation between printing data and dot shapes. In the printing data outputted by the controller 2, high potentials signify blank whereas low potentials signify output with a value, that means toner output. Ideally, the shape of a dot to be outputted is a rectangle (including square) composed of a side having a length of the nominal resolution of the output engine 7 in the sub scanning direction and a side having a length of one dot of the resolution of printing data in the main scanning direction. However, the shape of a dot actually developed is blurred around its boundary when the exposure device 17 exposes the photoconductor 15, resulting in the shape with its outline indistinct as shown in the drawing. Further, as the resolution in the main scanning direction increases, the amount of light exposure of the photoconductor 15 by the exposure device 17 becomes insufficient and hence the overall potentials of electrostatic latent images to be formed become high (not sufficiently lowered), which disables toner from being sufficiently absorbed and thereby lowers toner density, resulting in diluted images or total failure of development.

Figure 5:
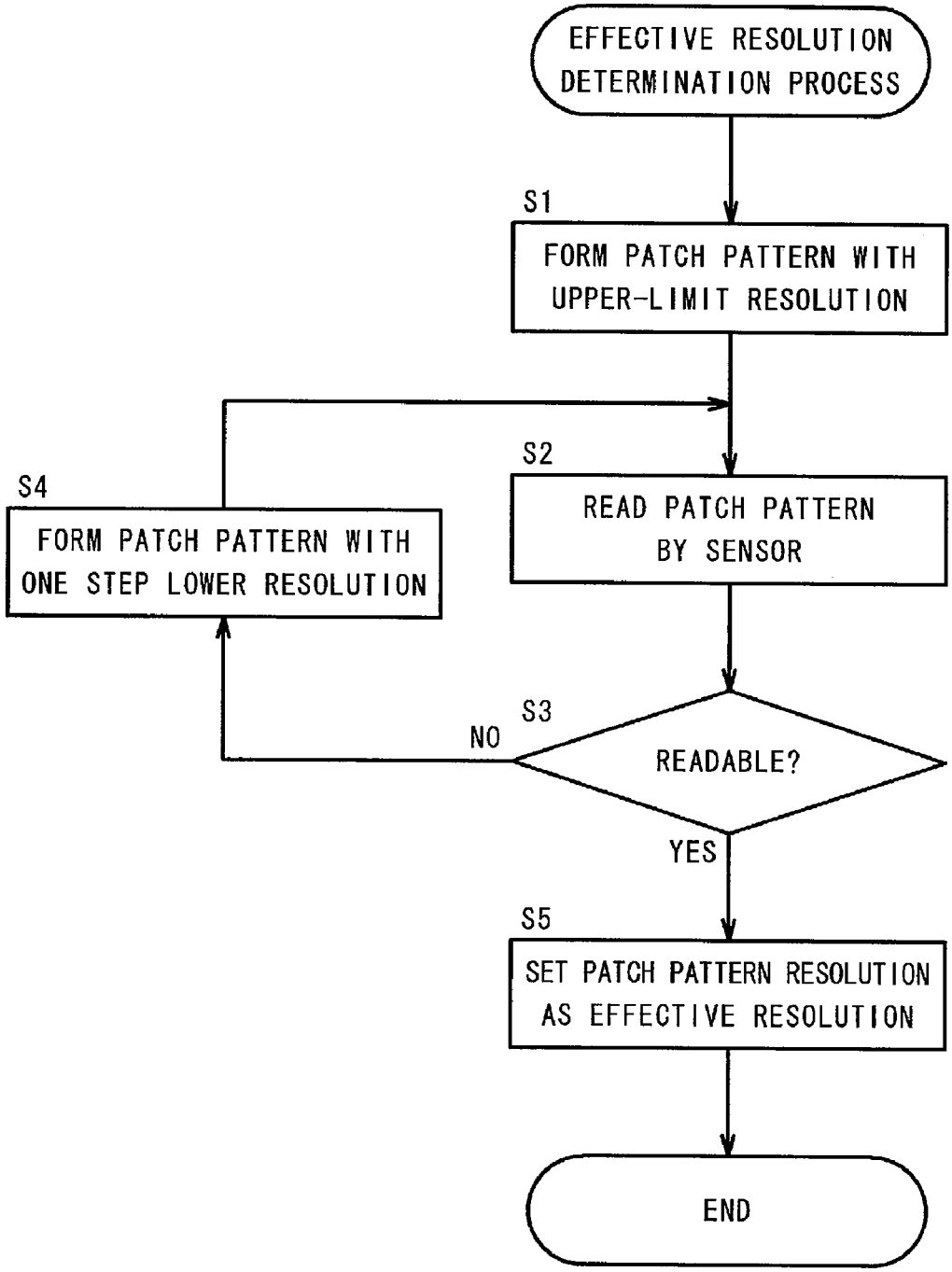
FIG. 5 is a flowchart showing effective resolution determination process in the image forming apparatus shown in FIG. 1.

Now, FIG. 5 shows a flowchart of effective resolution determination process (effective resolution determinator or condition determinator).

The effective resolution determination process is set to be executed automatically by the controller 2 at times, such as, when the power switch of the image forming apparatus is turned on, when the image forming apparatus returns from power saving standby mode, when image stabilization process is executed, and when a specified number of pages are printed.

In the effective resolution determination process, first, in step S1, a patch pattern of an upper-limit resolution processable by the controller 2 (e.g., 19200 dpi) is read from the resolution patch pattern storage section 5*b* and outputted into the output engine 7.

In step S2, the sensor 8 reads the patch pattern on the intermediate transfer belt 12 outputted in the step S1. More specifically, the timing of a toner image of the patch pattern passing a detection area of the sensor 8 is determined from speed of the intermediate transfer belt 12 and the like, and the output level of the sensor 8 is checked with this timing.

While the resolution patch pattern logically has a density of 50%, outputting the resolution patch pattern with a resolution exceeding the capacity of the output engine 7 lowers the density of actual patch patterns as described before, and therefore the sensor 8 is set to check images with a density further lower than the logical density of 50%.

In step S3, if an output level of the sensor 8 is lower than a specified value, then the patch pattern is not appropriately outputted, so that the controller 2 determines that the patch pattern is unreadable (undevelopable) and proceeds to step S4, where the controller 2 reads a patch pattern with a resolution one step lower than the previous one from the resolution patch pattern storage section 5*b*, and instructs the output engine 7 to form a next patch pattern.

In step S4, after the patch pattern with lower resolution is formed, the operation of forming a patch pattern is repeated with resolution lowered one level at a time till readout of the newly formed patch pattern is attempted in step S2 and the patch pattern is developed and determined to be readable in step S3.

If the patch pattern is recognized in step S3, then the process proceeds to step S5, where the resolution of the patch pattern that can be recognized by the sensor 8 is set as an effective resolution, which represents the resolution that the output engine 7 can develop and output with toner.

Figure 6:
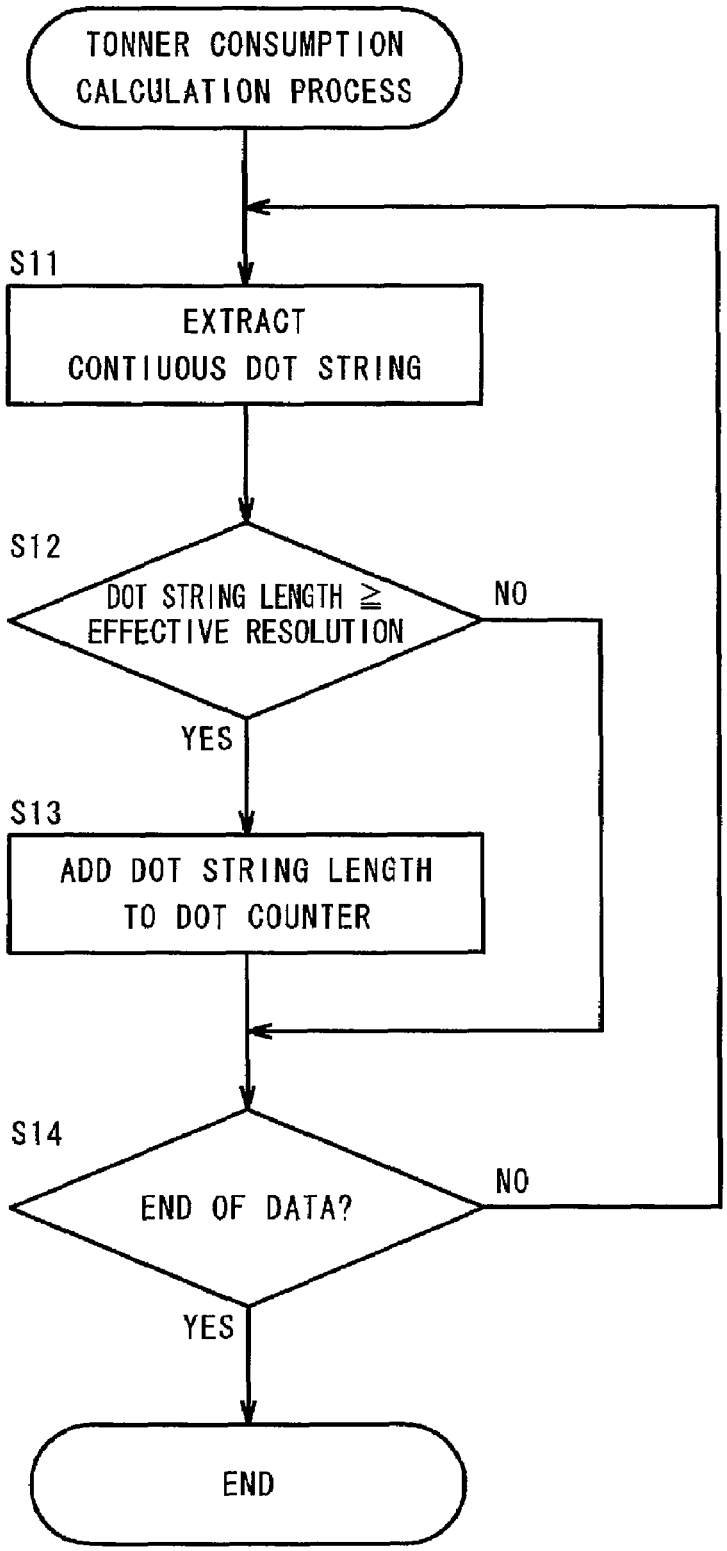
FIG. 6 is a flowchart showing toner consumption calculation process in the image forming apparatus shown in FIG. 1.

Further, FIG. 6 shows a flowchart of the process in toner consumption calculation process (dot counter) based on the above effective resolution. As described before, upon reception of image data in the transmit/receive section 9 or upon readout of image data by the scanner section 4, the image forming apparatus 1 converts RGB data to YMCK data in the image processing section 6, and the controller 2 converts the YMCK data to printing data consisting of continuous data with a resolution of the output engine 7 (e.g., 600 dpi) in the sub scanning direction and with an upper-limit resolution (e.g., 19200 dpi) of the controller 2 in the main scanning direction.

In step S11, the toner consumption calculation process implemented as a program of the controller 2 extracts a continuous dot string, i.e., a first set of data with a value, which continues without any blank data interposed therebetween, from printing data. It is to be noted that one dot interposed in between blank data is also extracted as a set of data with a value as the continuation number of 1.

In step S12, it is checked how much dots the length of the extracted data with a value is equivalent to with respect to the upper-limit resolution of the controller 2, and if the length is equal to or longer than the dot length corresponding to one dot of the effective resolution (determination condition), then the number of dots of the extracted dot strings with respect to the upper resolution of the controller 2 is added to a dot counter in step S13, before the process proceeds to step S14. If the length of the extracted data string is smaller than one dot of the effective resolution in step S12, then the process bypasses the step S13 and proceeds directly to step S14 (count controller).

In step S14, it is checked whether or not the extracted data is a last set of data with a value, among the printing data, and if the consequent data with a value is not present, then the process is ended. If further data with a value is present after the present extracted data in step S14, then the process returns to step S11 to extract the next data string and the consequent process is repeated.

With this process, in the printing data, the data string with a value, having a length equal to or longer than one dot of effective resolution, is counted by the dot counter, whereas the data with a value, separated by blank data so as not to be able to satisfy the length of one dot of effective resolution, is not counted by the dot counter.

Figure 7:
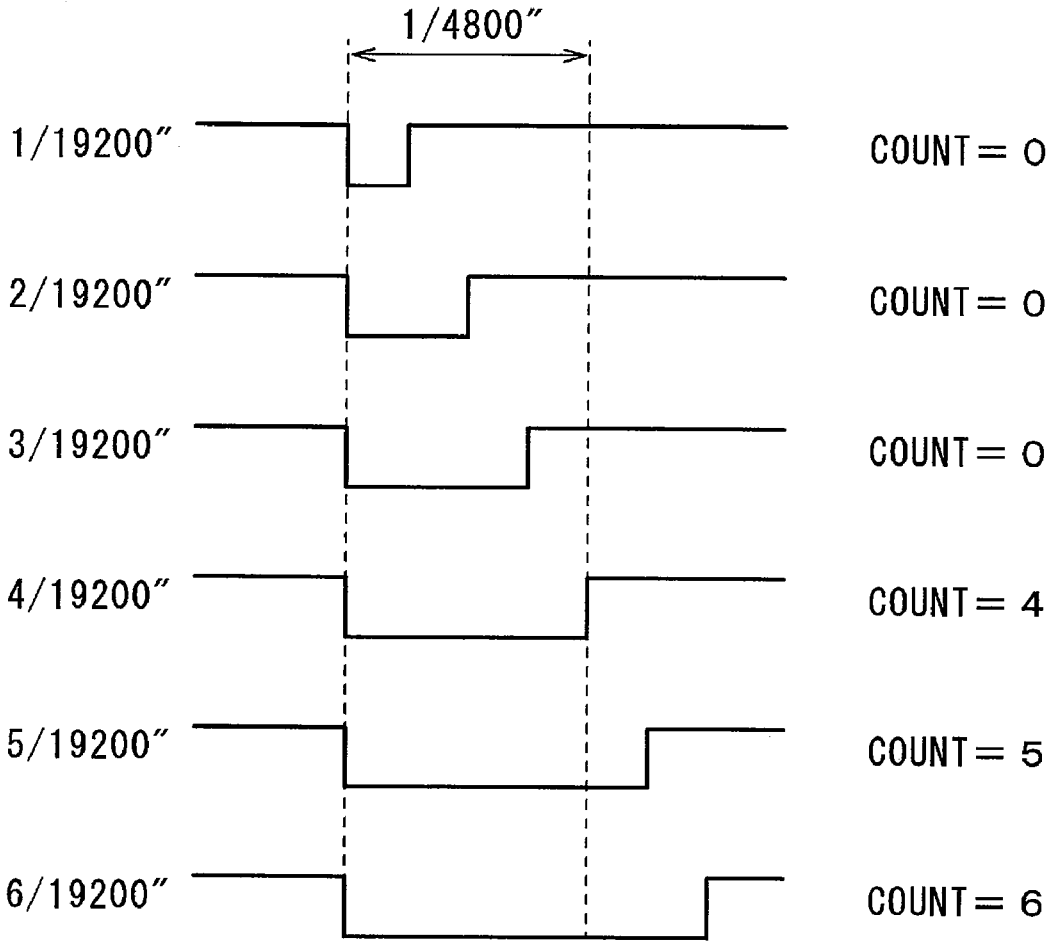
FIG. 7 is a view showing a relationship between the printing data and count in the process shown in FIG. 5.

For example, as shown in FIG. 7, the controller 2 outputs printing data with resolution corresponding to 19200 dpi. In the case where the effective resolution is 4800 dpi, printing data corresponding to one dot at 19200 dpi, printing data equivalent to 9600 dpi, which corresponds to two dots at 19200 dpi, and printing data corresponding to three dots at 19200 dpi, are not added to the counter, whereas in the case of data equivalent to 4800 dpi, which corresponds to 4 dots at 19200 dpi, 4 dots in terms of 19200 dpi are added to the counter, and in the case of data of 5 dots or more at 19200 dpi, the dot length in term of 19200 dpi is added to the counter.

The controller 2 uses the total count value of the dot counter, as it is, as a value proportional to toner consumption. For example, an initial value is obtained in advance by converting a filling amount of a new toner bottle 21 to a dot counter value, and when the total count value of the dot counter reaches the initial value, replacement request of the toner bottle 21 is displayed on the operation display section 3 so as to call attention to users. Moreover, the presence of data on a volume of the developing device 18 converted to a dot counter value makes it possible to estimate the remaining amount of toner present in the developing device 18 based on the dot counter value after the sensor detected that the toner bottle 21 is empty, thereby allowing issuance of appropriate warning to users.

In the case where the total count value of the dot counter is smaller compared to the number of printing pages, the toner consumption is small, i.e., the amount of toner, which is fed from the developing device 18 to the photoconductor 15 but is collected without being absorbed by the photoconductor 15, is large, as a result of which the risk of causing printing failure due to entrapment of impurities and potential fault of toner becomes high. Therefore, the number of printing pages and the total count value of the dot counter are compared, for example, every time a certain number of pages are printed, and if the toner consumption is determined to be too small, a patch image which is not to be transferred onto the intermediate transfer belt 12 is developed on the photoconductor 15 and is disposed of by the cleaner 20, so that old toner repeatedly coming and going from the developing device 18 can mandatorily be consumed and new toner can be fed to the developing device 18 from the toner bottle 21, by which degradation of printing quality can be prevented.

Figure 8:
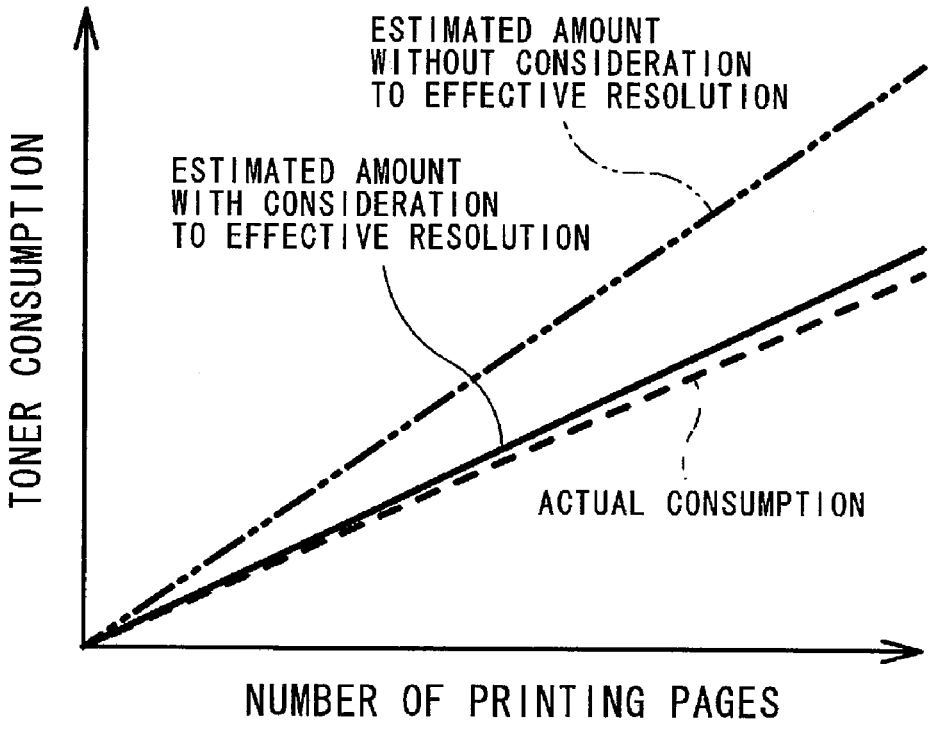
FIG. 8 is a view showing actual toner consumption and its estimated value in the image forming apparatus shown in FIG. 1.

FIG. 8 shows actual toner consumption in the case where images with high resolution are repeatedly printed, an estimated value of toner consumption from an total count value of the dot counter in the present embodiment, and an estimated value of toner consumption from the dot counter in the case where all the dots on the printing data are counted up without determination of effective resolution. In these graphs, three lines are to be generally identical when image data to be printed is data with low resolution equal to or lower than the nominal resolution of the output engine 7.

As shown in the figure, determining the effective resolution makes it possible to make the estimated value of toner consumption by the dot counter closer to an actual consumption, and therefore even without mounting a number of sensors for checking actual toner consumption (remaining amount) on the developing device 18 and the toner bottle 21, appropriate judgment regarding the remaining amount of toner can be ensured.

Figure 9:
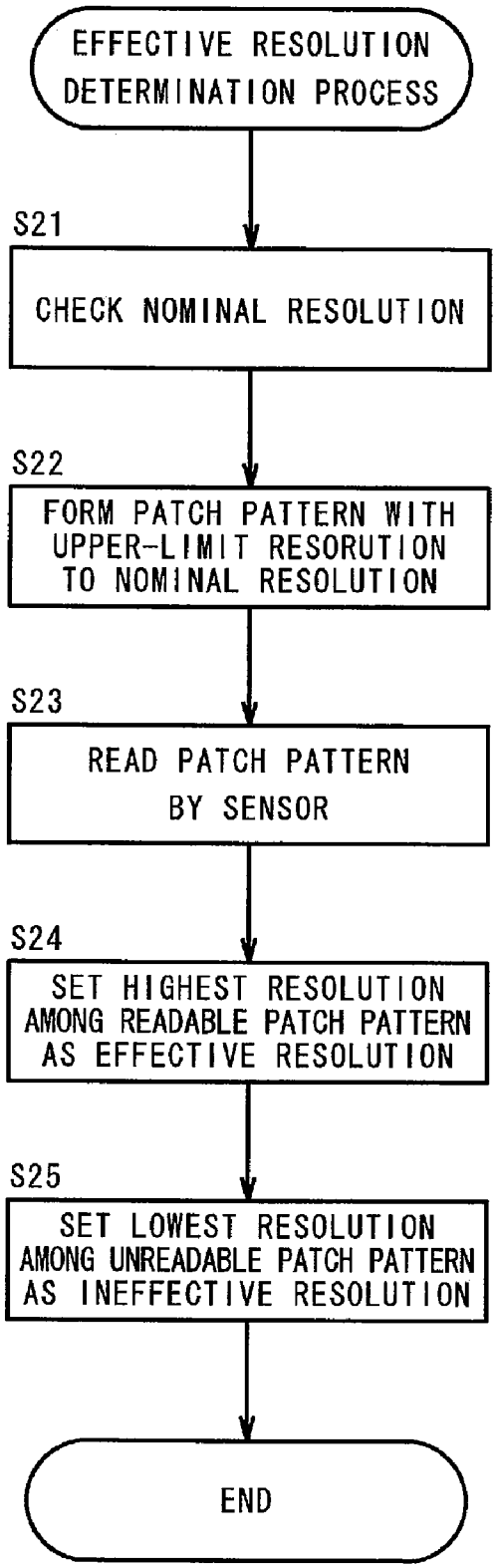
FIG. 9 is a flowchart showing effective resolution determination process in a second embodiment of the present invention.

Further, FIG. 9 shows a flowchart of effective resolution determination process in an image forming apparatus 1 in a second embodiment of the present invention. In the present embodiment, the structure of the image forming apparatus 1 is identical to that of the first embodiment except that process performed by a program of the controller 2 is different, and therefore redundant explanation will be omitted.

In the effective resolution determination process in the image forming apparatus 1 in the present embodiment, the controller 2, first, communicates with the output engine 7 to recognize the nominal resolution of the output engine 7 in step S21.

Then in step S22, the controller 2 reads all the resolution patch patterns with resolution higher than the nominal resolution of the output engine 7 from the resolution patch pattern storage section 5*b* and instructs continuous output to the output engine 7.

Figure 10:
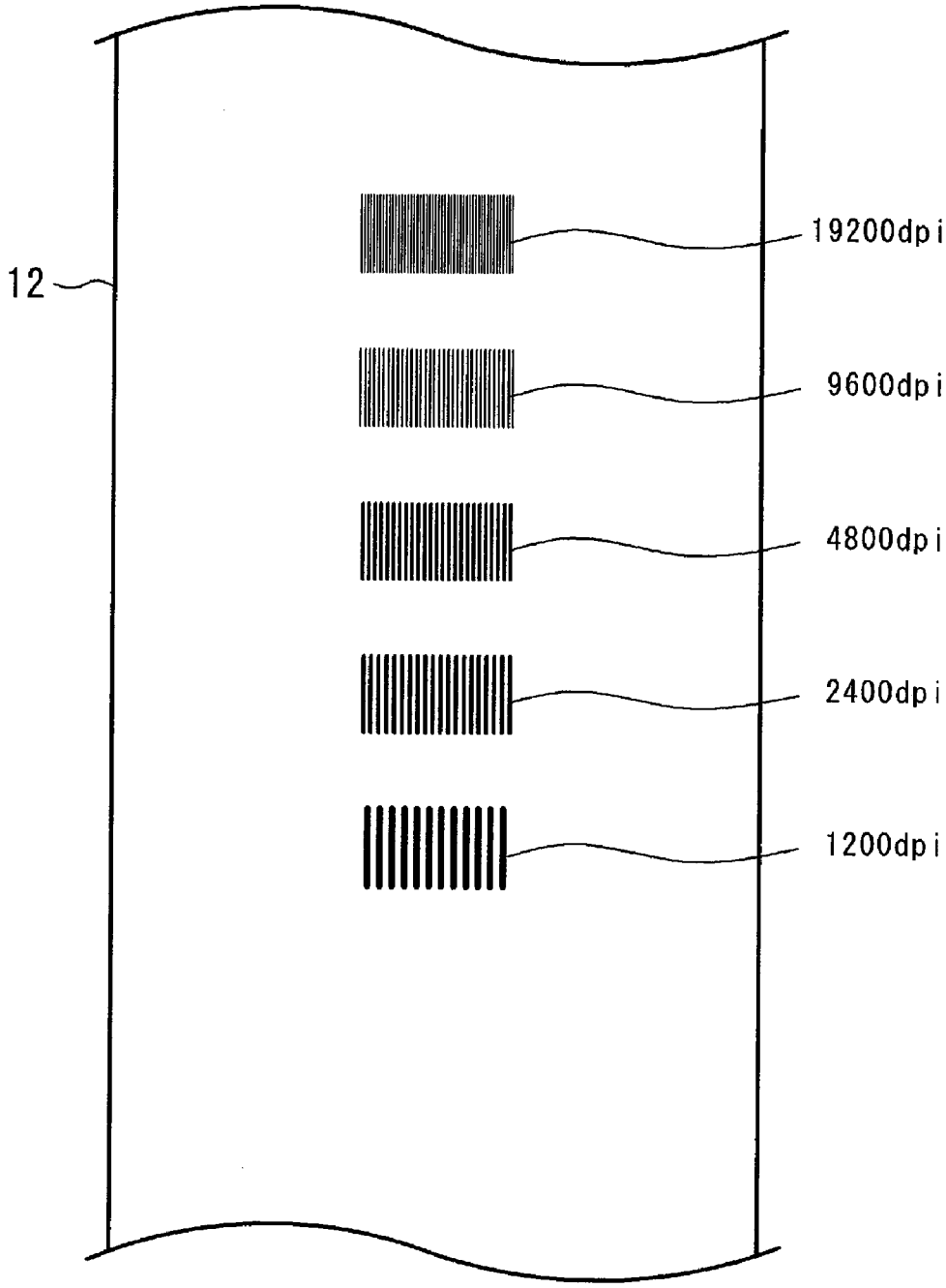
FIG. 10 is a view showing an intermediate transfer belt with resolution patch patterns formed thereon in the process shown in FIG. 8.

FIG. 10 shows the intermediate transfer belt 12 which outputted resolution patch patterns in step S22 by way of example. For example, in the case where the upper-limit resolution of the controller 2 is 19200 dpi and the nominal resolution of the output engine 7 is 600 dpi, the resolution patch patterns from 1200 dpi to 19200 dpi are outputted so as to be set in array. Although the resolution patch pattern of 600 dpi, the nominal resolution of the output engine 7, is not printed since it is clear that the nominal resolution can be developed, this does not means that the printing of the nominal resolution for checking purpose be excluded.

To return to the flow in FIG. 9, after outputting the resolution patch patterns, the controller 2 instructs the sensor 8 to read resolution patch patterns of respective resolutions in step S23, and determines that each of the resolution patch patterns is respectively readable if the output level of the sensor 8 is equal to or larger than a specified value.

In step S24, the controller 2 sets the resolution of a resolution patch pattern with highest resolution, among the resolution patch patterns readable in step S23, as effective resolution.

Further, in the present embodiment, in step S25, the resolution of a patch pattern with the lowest resolution, among unreadable resolution patch patterns, is set as a ineffective resolution. The ineffective resolution is the lowest resolution actually recognized by the output engine 7 to be undevelopable.

In the present embodiment, the resolution patch patterns of resolutions higher than the nominal resolution of the output engine 7 are sequentially outputted and checked by the sensor 8 so that the number of waiting times to wait the intermediate transfer belt 12 to rotate from the developing units 11Y, 11M, 11C and 11K to the sensor 8 can be limited to one time, which makes allows the entire process to reduce the time to wait the intermediate transfer belt 12 to rotate and to perform effective resolution determination in a short period of time.

Figure 11:
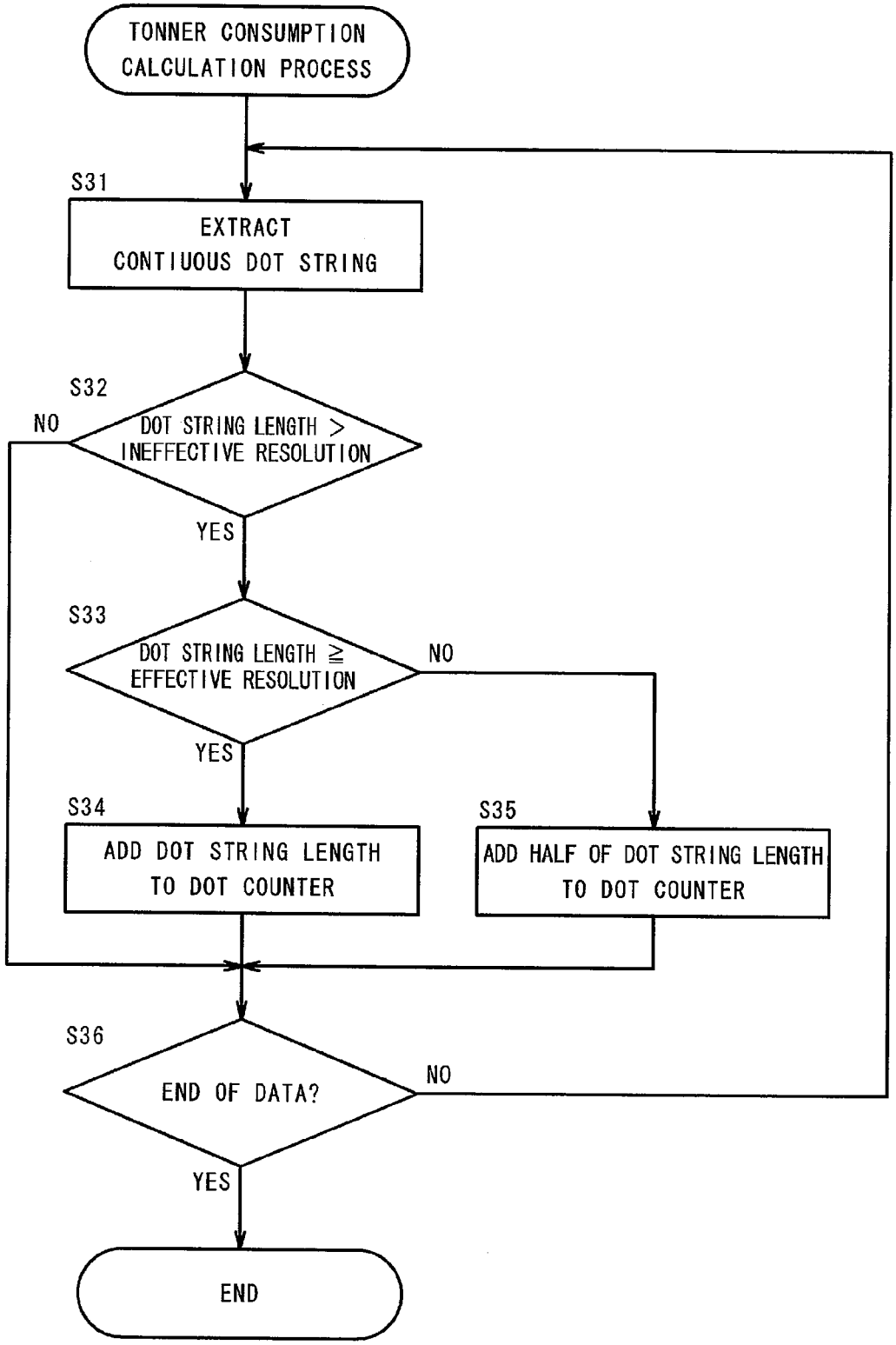
FIG. 11 is a flowchart showing toner consumption calculation process in the second embodiment of the present invention.

Further, FIG. 11 shows the flowchart of process in toner consumption calculation process (dot counter) implemented as a program of the controller 2 in the present embodiment.

In the toner consumption calculation process, a dot string consisting of continuous data with a value is extracted from a printing data string in step S31.

In step S32, it is checked whether or not the length of the extracted data with a value is equal to or longer than a length corresponding to one dot of ineffective resolution, and if the extracted data is longer than one dot of the ineffective resolution, then it is further checked in step S33 whether or not the length of the extracted data with a value is equal to or longer than the length corresponding to one dot of effective resolution.

If the length of a dot string consisting of data with a value is equal to or longer than the length of one dot of effective resolution in step S33, then the number of dots in the dot string is added to the dot counter in step S34. If the length of the dot string consisting of data with a value is shorter than the length of one dot of effective resolution in step S33, then half the dot number in the dot string is added to the dot counter in step S35.

Upon finishing addition of the dot counter or in the case where the g length of a string consisting of data with a value is equal to or smaller than the length of one dot of ineffective resolution in step S34 or step S35, addition of the dot counter is not performed and the process proceeds to step S36, where it is checked whether or not the extracted data dot string is the last data with a value in the printing data, and if no more dot strings consisting of data with a value exist, then the process is ended. In the case where a dot string consisting of data with a value further exists after the current extracted data in step S36, then the process returns to step S31, where the next data string is extracted and subsequent process is repeated.

In the present embodiment, when the length of an extracted dot string is equal to or longer than the length of one dot of ineffective resolution, addition is not made to the dot counter, whereas when the length of an extracted dot string is longer than one dot of ineffective resolution and shorter than the length of one dot of effective resolution, half the number of dots in the string length is added to the dot counter. Further, when the length of an extracted dot string is longer than the length of one dot of effective resolution, the number of dots of the string length is added to the dot counter.

Printing data, consisting of a dot string continuing in a length larger than the length of one dot of ineffective resolution and smaller than the length of one dot of effective resolution, is not checked whether or not it can be developed in actuality. Accordingly, addition to the dot counter is made assuming that dots of the printing data with the unchecked resolution could be developed with probability ½, by which a difference between the actual toner consumption and its estimated value by the dot counter can be more decreased.

The present invention is applicable to color printers, facsimiles, copiers and complex machines composed thereof.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus, comprising:

an output engine having a photoconductor, a charger for charging the photoconductor, an exposure device for forming an electrostatic latent image by selectively exposing the charged photoconductor while scanning the charged photoconductor, and a developing device for feeding a developer to the electrostatic latent image for development;

a controller for converting image data received from an external or other component to printing data consisting of continuous data in a main scanning direction of the exposure device and for inputting the converted data into the output engine so as to output an image;

an effective resolution determinator for forming a plurality of patch patterns different in resolution by the output engine, checking by a sensor whether or not the patch patterns formed by the output engine are developed with developer, and determining that a resolution of the patch pattern with highest resolution recognizable by the sensor, is an effective resolution which can be outputted by the output engine; and a dot counter for counting number of continuous dots constituting an image equal to or longer than a length of one dot of the effective resolution in the printing data.

2. The image forming apparatus according to claim 1, wherein the controller checks nominal resolution guaranteed by the output engine and instructs the output engine to form only the patch patterns with resolution higher than the nominal resolution.

3. The image forming apparatus according to claim 1, wherein the dot counter counts number of dots continuing for a length equal to or longer than a length corresponding to one dot of the effective resolution in a main scanning direction.

4. The image forming apparatus according to claim 3, wherein the effective resolution determinator further defines the resolution of the patch pattern with lowest resolution among the patch patterns unreadable by the sensor as ineffective resolution, and wherein the dot counter also counts half the number of dots continuing for a length longer than a length of one dot of the ineffective resolution and shorter than a length of one dot of the effective resolution.

5. The image forming apparatus according to claim 1, wherein the effective resolution determinator determines the effective resolution for every certain number of printing pages.

6. The image forming apparatus according to claim 1, wherein the effective resolution determinator determines the effective resolution at power-on.

7. The image forming apparatus according to claim 1, wherein the effective resolution determinator determines the effective resolution during image stabilization operation.

8. The image forming apparatus according to claim 1, wherein a remaining amount of developer in a developer bottle for feeding the developer to the developing device is estimated based on dot number counted by the dot counter.

9. The image forming apparatus according to claim 1, wherein a remaining amount of developer in the developing device is estimated based on dot number counted by the dot counter.

10. The image forming apparatus according to claim 1, wherein there is provided a mandatory discharger for checking dot number counted by the dot counter and for discharging a certain amount of developer from the developing device on a mandatory basis if the counted dot number is smaller than a value obtained by multiplying a predetermined amount by printing page number.

11. The image forming apparatus according to claim 10, wherein the mandatory discharger checks dot number counted by the dot counter for every printing of a certain number of pages.

* * * * *